US005253921A

United States Patent [19]

Boulet

[11] Patent Number: 5,253,921

[45] Date of Patent: Oct. 19, 1993

[54] FOLDABLE ROCKING CHAIR

[75] Inventor: Gilles Boulet, St-Gérard-de-Majella, Canada

[73] Assignee: Muebles St-Gerard Inc., Quebec, Canada

[21] Appl. No.: 829,702

[22] Filed: Jan. 31, 1992

[30] Foreign Application Priority Data

Apr. 26, 1991 [CA] Canada ..... 2041306

[51] Int. Cl.[5] ..... A47C 3/02

[52] U.S. Cl. ..... 297/32; 297/16.1; 297/39; 297/261

[58] Field of Search ..... 297/32, 18, 16, 35, 297/39, 40, 261

[56] References Cited

U.S. PATENT DOCUMENTS 251,783 1/1882 Johnson et al. .
622,149 3/1899 Holton .
676,788 6/1901 Wallis .
890,192 6/1908 Stombaugh .
3,083,051 3/1963 Milbourne .
3,671,072 6/1972 Holt .

*Primary Examiner*—James R. Brittain
*Attorney, Agent, or Firm*—Dick and Harris

[57] ABSTRACT

A foldable rocking chair of the type comprising in combination: a base provided with a pair of parallel riding surfaces spaced apart from each other and connected together, each riding surface being undulated; a back provided with a pair of stiles, a lower portion of each stile defining a short rear leg; a seat; a pair of main rear legs, each leg having an upper portion, an intermediate portion and a lower portion provided with rolling means; a pair of front members, each member having a upper portion defining a stem and a lower portion provided with rolling means; a pair of arms; a pair of connecting members; six pairs of connectors. Each connector defines means for pivotally connecting parts together and defining a pivoting axis substantially horizontal and perpendicular with the longitudinal axis of riding surfaces. Aforesaid stiles, arms, front members, legs, seat and connecting members are movable around their corresponding connectors between a folded position and a unfolded position.

20 Claims, 5 Drawing Sheets

FOLDABLE ROCKING CHAIR

BACKGROUND OF THE INVENTION

1. Field of the Invention

The invention relates to a foldable rocking chair of the type comprising a stationary base.

2. Description of the Prior Art

The prior art reveals the existence of various kinds of foldable rocking chairs provided with a pair of rockers. For example, U.S. Pat. Nos. 251,783 (Johnson et al.), 662,149 (Holton), 676,788 (Wallis), 890,192 (Stombaugh), 3,083,051 (Milbourne) and 3,671,072 (Holt), all disclose rocking chairs that are provided with a pair of rockers and are foldable when the back is moved with respect to the seat because their legs, back, seat, rockers and, eventually arms, are pivotally connected together.

Also, it is known in the art to embody large rocking chairs, especially a garden rocking chair, where two or more persons can take place simultaneously. Such a garden rocking chair comprises a stationary base provided with two pairs of parallel riding surfaces on its top surface, and a frame provided with wheels, each wheel being intended to ride on a corresponding riding surface, and opposite benches. Each riding surface is bowed downwardly like a rocker, so as when a wheel ride thereon, the frame is allowed to move forward and backward.

Therefore, in spite of the fact that there is a need for a foldable rocking chair of the type provided with a stationary base, this need has never been satisfied. In the prior art, either rocking chairs are foldable and provided with conventional rockers, or they are not foldable and they are provided with a stationary base. The prior art failed, up to now, to embody a foldable rocking chair of the type provided with a stationary base.

SUMMARY OF THE INVENTION

An object to the present invention is to provide a rocking chair that is at once foldable and provided with a stationary base.

Another object of the invention is to provide a foldable rocking chair provided with a stationary base that is easy to manufacture at low cost.

A still further object of the invention is to provide a rocking chair provided with a stationary base that can be folded and stored easily.

A still further object of the invention is to provide a foldable rocking chair provided with a stationary base that is very easy to fold and unfold by the user.

More particularly, the present invention relates to a foldable rocking chair of the type comprising in combination:

A stationary base provided with parallel riding surfaces spaced apart from each other and connected together, each riding surface having a longitudinal axis and being undulated with respect to its longitudinal axis. Preferably, the base is provided with a pair of parallel rails spaced apart from each other and connected together, each rail having a longitudinal axis and being provided with a cavity in a longitudinal side thereof. This cavity has a lower part, an upper part spaced apart from the lower part by a height, and a longitudinal axis parallel with the longitudinal axis of the rail. Each undulated riding surface is defined by the lower part of a corresponding cavity. It is to be understood that the height of each cavity is sufficient to allow a free riding of rolling means on a corresponding riding surface.

A back provided with a pair of stiles, each stile being spaced apart form each other. A lower portion of each stile defines a short rear leg.

A seat, preferably a seat of the type provided with two parallel boards spaced apart from each other and connected together with at least one top element.

A pair of main rear legs, each leg having an upper portion, an intermediate portion and a lower portion. The lower portion of each leg, especially near its end, is provided with rolling means intended to ride forward and backward on a portion of a corresponding riding surface.

A pair of front members, each member having an upper portion defining a stem and a lower portion defining a front leg. Each front leg, especially near the lower end of the front leg,is provided with rolling means intended to ride forward and backward on a portion of a corresponding riding surface.

A pair of arms, each arm having opposite ends.

A pair of connecting members, each member having opposite ends.

Six pairs of connectors, each connector defining means of the type for connecting parts together and for pivotally moving these parts around a pivoting axis that is substantially horizontal and perpendicular with respect to the longitudinal axis of riding surfaces. The pivoting axis of each connector of a same pair of connector are substantially co-axial.

Each connector of a first pair of connectors pivotally connects the seat with a corresponding stile, just above the short rear leg.

Each connector of a second pair of connectors pivotally connects the seat with the upper portion of a corresponding main rear leg and a corresponding front member between its upper and lower portions.

One connector of a third and a fourth pairs of connectors pivotally connect, respectively, opposite ends of one arm with respectively a corresponding upper part of the front member and a corresponding stile, above the connector connecting the seat with that stile, the other connector of a third and a fourth pairs of connectors pivotally connect, respectively, opposite ends of the other arm with respectively a corresponding upper part of the front member and a corresponding stile, above the connector connecting the seat with that stile.

One connector of a fifth and sixth pairs of connectors pivotally connect, respectively, opposite ends of one connecting member with respectively an intermediate portion of a corresponding main rear leg and a corresponding short rear leg, the other connector of a fifth and sixth pairs of connectors pivotally connect, respectively, opposite ends of the other connecting member with respectively an intermediate portion of a corresponding main rear leg and short rear leg.

Aforesaid stiles, arms, front members, main rear legs, seat and connecting members are movable around pivoting axis defined by their corresponding connectors between a folded position and an unfolded position.

The folded position of the aforesaid rocking chair may be obtained when the back is tilted over the seat around pivoting axis of each connector of the first pair of connectors, connecting members are moved around the pivoting axis defined by each connector of the fifth and sixth pairs of connectors from a locked position where the pivoting axis defined by each connector of the fifth pair of connectors is positioned ahead a plane that is substantially coplanar with the pivoting axis defined by connectors of the first and sixth pairs of connectors, and each short rear leg applies against the intermediate portion of a corresponding rear leg, to an unlocked position where the pivoting axis defined by each connector of the fifth pair of connectors is positioned behind the plane that is substantially coplanar with pivoting axis defined by connectors of the first and sixth pairs of connectors, ends of the arms are moved around corresponding pivoting axis defined by connectors of the third and fourth pairs of connectors, front members are moved around the pivoting axis defines by each connector of the second pair of connectors in such a way that rolling means of the front legs are ridden on the riding surfaces from a first position where rolling means of the front legs are positioned ahead a substantially vertical plane coplanar with pivoting axis defined by connectors of the second pair of connectors, to a second position where rolling means of the front legs are positioned behind the substantially vertical plane toward rolling means of the main rear legs. Aforesaid arms, back, seat, front members, intermediate and upper portions of the main rear legs are lowered toward the base.

The unfolded position of aforesaid rocking chair may be obtained when the aforesaids steps are reversed until the pivoting axis defined by each connector of the fifth pair of connectors is positioned ahead the plane that is substantially coplanar with the pivoting axis defined by connectors of the first and sixth pairs of connectors, short rear legs respectively apply against the intermediate portion of a corresponding main rear leg, and rolling means of the front legs are positioned ahead the substantially vertical plane.

BRIEF DESCRIPTION OF THE DRAWINGS

The present invention will be better understood with the following non restrictive description of preferred embodiments thereof, made with reference to the accompaning drawings in which:

Referring to FIG. 1, there is represented a foldable rocking chair "C" of the type comprising in combination: a stationary base 1, a back 3, a seat 5, a pair of main rear legs 7, a pair of front members 11, a pair of arms 15, and a pair of connecting members 19.

Of course, the chair "C" has identical left and right sides. Therefore, for clarification purposes of the following preferred description when a part of the chair is described in one side thereof, there is an identical part on the other side of said chair.

Figure 1:
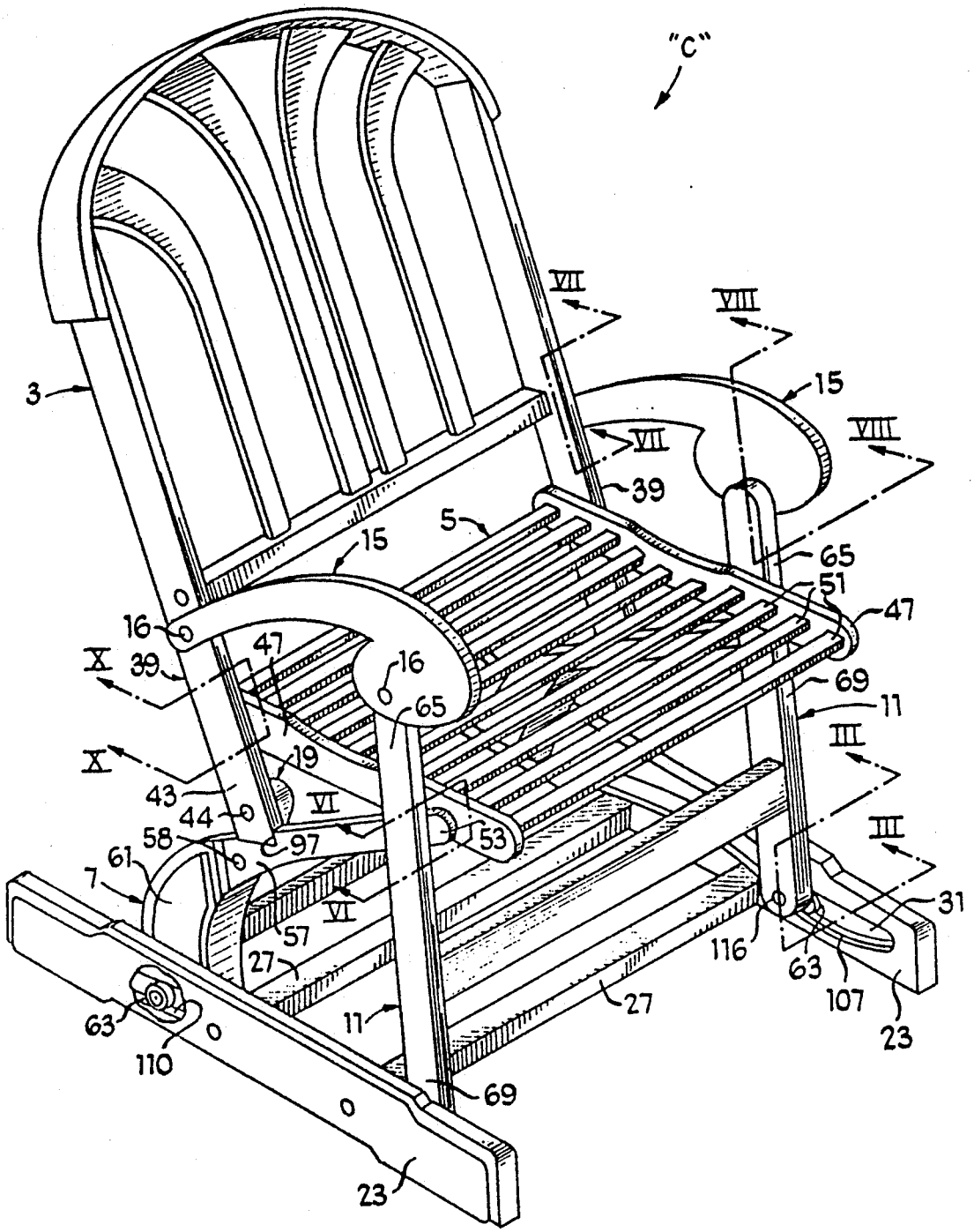
FIG. 1 is a perspective view of a foldable rocking chair provided with a stationary base, according to the invention.

The base 1 is provided with a pair of parallel rails 23, spaced apart from each other and connected together with two ties 27. Rails 23 have a longitudinal axis and are each provided in a longitudinal side thereof, with a cavity 31 comprising an undulated riding surface. Cavities 31 have a longitudinal axis parallel with the longitudinal axis of rails 23. Although the cavity 31 of each rail could be on either longitudinal sides of a rail 23, they are preferably, as illustrated in FIG. 1, facing to each other.

The back 3 is provided with a pair of stiles 39, spaced apart from each other. A lower portion of each stile 39 defines a short rear leg 43.

The seat 5 may consists of two parallel boards 47, spaced apart from each other and connected together with at least one top element, advantageously, a plurality of top elements 51.

A pair of main rear legs 7, each having an upper portion 53, an intermediate portion 57 and a lower portion 61. Lower portions 61 each are provided with a rolling means 63 intended, when the chair is unfolded, as represented in FIG. 1, to ride forward and backward on a portion of a corresponding riding surface 110 (see FIG. 4). Preferably, each intermediate portion 57 is further provided with a stopper 97 (see FIGS. 1, 2 and 4).

A pair of front members 11 each having an upper portion defining a stem 65 and a lower portion defining a front leg 69. These front legs 69, each are provided with rolling means 63 intended, when the chair is unfolded as represented in FIG. 1, to ride forward and backward on a portion of a corresponding riding surface 110 (see FIG. 3).

A pair of arms 15 having opposite ends, and a pair of connecting members 19 having opposite ends.

The foldable rocking chair "C" also comprises six pairs of connectors, each connector having a pivoting axis substantially horizontal and perpendicular with the longitudinal axis of the riding surface 110.

Figure 10:
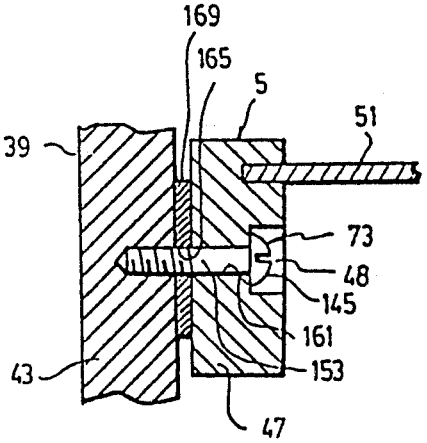
FIG. 10 is a cross sectional view, according to X—X in FIG. 1, of a connector pivotally connecting a board of the seat with a stile.

Referring to FIG. 10, a connector 73 of a first pair of connectors, pivotally connects the seat 5, especially one board 47 with a corresponding stile 39, just above the short rear leg 43. Similarily, another connector 73 (not represented) pivotally connects the seat 5, especially the other board 47, with the other stile 39, just above the short rear leg 43.

According to a particularly preferred embodiment of the invention, each connector 73 consists of a screw having a head 145 and a stem 153 whose a portion opposite the head 145 is threaded. Each connector 73 passes through a bore 161 provided in a corresponding board 47, eventually, according to an advantageously preferred embodiment, through a bore 165 of a washer 169, and has its threaded portion screwed in a corresponding stile 39, until the head 145 is close the board 47. Avantageously, each board 47 may be provided with a recess 48 for housing a corresponding head 145.

Figure 6:
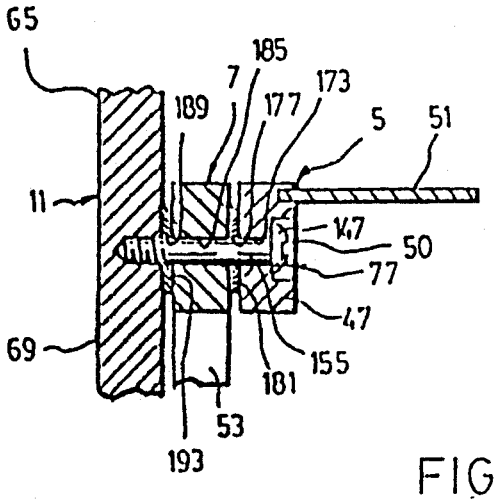
FIG. 6 is a cross sectional view, according to VI—VI in FIG. 1 of a connector pivotally connecting a board of the seat, the upper part of a main rear leg and a front member.

Referring to FIG. 6, a connector 77 of a second pair of connectors, pivotally connects the seat 5, especially one board 47, with the upper portion 53 of a corresponding main rear leg 7 and a corresponding front member 11 between its upper and lower portions. Similarily, another connector 77 (not represented) pivotally connects the seat 5, especially the other board 47, with the upper portion 53 of the other main rear leg 7 and the other front member 11, between its upper and lower portions.

According to a particularly preferred embodiment of the invention, each connector 77 consists of a screw having a head 147 and a stem 155 whose a portion opposite the head 147 is threaded. Each connector 77 passes through a bore 173, provided in a corresponding board 47, eventually, according to an advantageously preferred embodiment, through a bore 177 of a washer 181, a bore 185 provided in the upper portion 53 of a corresponding main rear leg 7, eventually, according to an advantageously preferred embodiment, through a bore 189 of a washer 193, and has its threaded portion screwed in the front member 11, between its upper and lower portions, until the head 147 is close the board 47. Advantageously, each board 47 may be provided with a recess 50 for housing the head 147.

Figure 7:
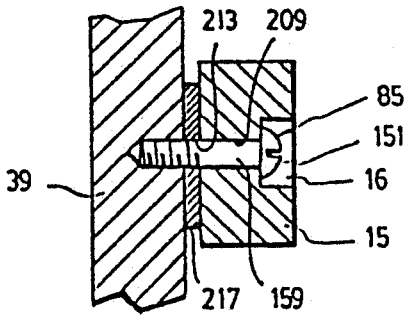
FIG. 7 is a cross sectional view, according to VII—VII in FIG. 1, of a connector pivotally connecting an arm with a stile.
Figure 8:
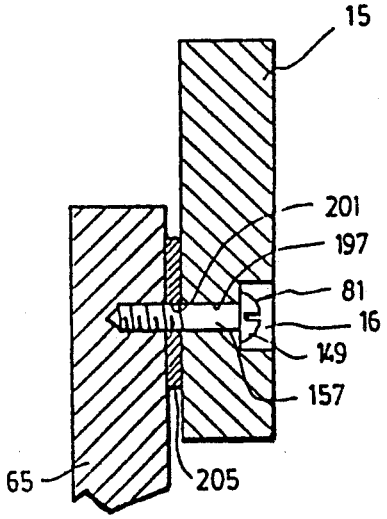
FIG. 8 is a cross sectional view, according to VIII—VIII in FIG. 1, of a connector pivotally connecting an arm with a front member.

Referring to FIGS. 7 and 8, a connector 81 of a third pair of connectors, and a connector 85 of a fourth pair of connectors, pivotally connect, respectively, opposite ends of one arm 15 with respectively a corresponding stem 65, and a corresponding stile 39 (above the connector 73). Similarily, another connector 81 and another connector 85 pivotally connect, respectively, opposite ends of the other arm 15 with respectively the other stem 65 and the other stile 39.

According to a particularly preferred embodiment of the invention, each connector 81 consists of a screw having a head 149 and a stem 157 whose a portion opposite the head 149 is threaded. Each connector 81 passes through a bore 197 provided in a corresponding arm 15, eventually, according to an advantageously preferred embodiment, through a bore 201 provided in a washer 205, and has its threaded portion screwed in the stem 65, until the head 149 is close the arm 15.

According to a particularly preferred embodiment of the invention, each connector 85 consists of a screw having a head 151 and a stem 159 whose a portion opposite the head 151 is threaded. Each connector 85 passes through a bore 209 provided in a corresponding arm 15, eventually, according to an advantageously preferred embodiment, through a bore 213 provided in a washer 217 and has its threaded portion screwed in a corresponding stile 39, until the head 151 is close the arm 15.

Advantageously, the arm 15 may be provided with recess 16 for housing the heads 149 and 151.

Figure 4:
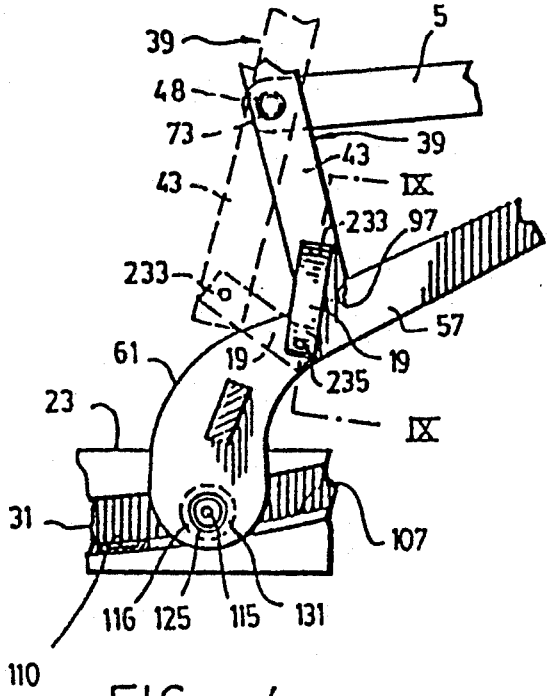
FIG. 4 is a partial side elevation view of the rear leg of the chair representing the motion of a connecting member between the locked position (in full lines) and the unlocked position (in dotted lines)
Figure 5:
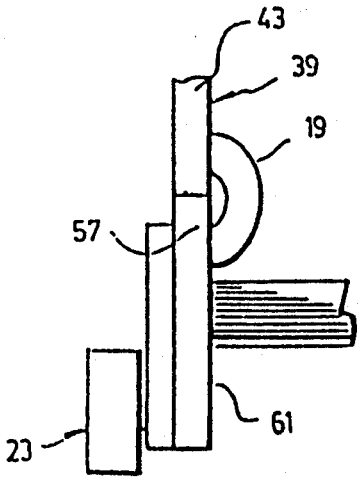
FIG. 5 is a partial rear elevational view of the rear legs shown in FIG. 4.
Figure 9:
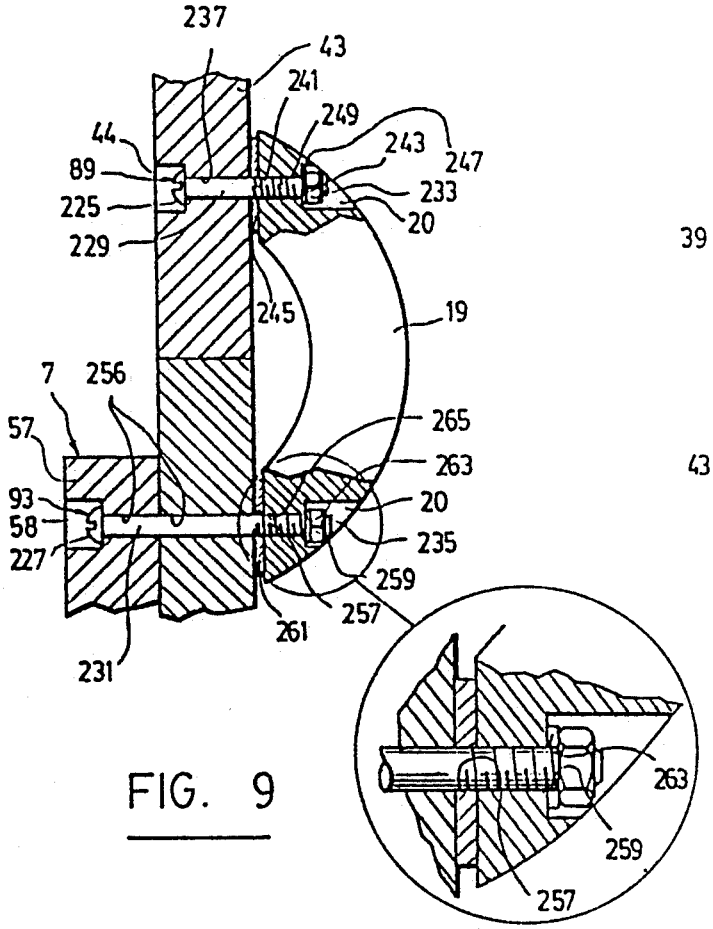
FIG. 9 is a cross sectional view, according to IX—IX in FIG. 4, of connectors pivotally connecting a connecting member with a main rear leg and a stile.

Referring to FIGS. 4, 5 and 9, a connector 89 of a fifth pair of connectors and a connector 93 of a sixth pair of connectors, pivotally connect, respectively, opposite ends of one connecting member 19 with respectively an intermediate portion 57 of a corresponding main rear leg 7 and a corresponding short rear leg 43. Similarily, another connector 89 and another connector 93 pivotally connect, respectively, opposite ends of the other connecting member 19 with respectively the other main rear leg 7 and the other short rear leg 43.

According to a particularly preferred embodiment of the invention, each connector 89 consists of a bolt having a head 225 and a stem 229, whose a portion is threaded, and a nut 233 screwed on the threaded portion of the stem 229. Each connector 89 passes through a bore 237 provided in a corresponding short rear leg 43, eventually, according to an advantageously preferred embodiment, through a bore 241 provided in a washer 245, and a bore 249 provided in a corresponding connecting member 19, and eventually, according to an advantageously preferred embodiment, through a bore 243 provided in a washer 247. The nut 233 is screwed on the threaded portion of the stem 229 until the head 225 and the nut 233 (or the washer 247 and the nut 233) are respectively close the short rear leg 43 and the connecting member 19.

According to a particularly preferred embodiment of the invention, each connector 93 consists of a bolt having a head 227 and a stem 231 whose a portion is threaded, and a nut 235 screwed on the threaded portion of the stem 231. Each connector 93 passes through a bore 256 provided in a corresponding intermediate portion of the main rear leg 7, eventually, according to an advantageously preferred embodiment, through a bore 257, provided in a washer 261, a bore 265 provided in the connecting member 19, and eventually, according to an advantageously preferred embodiment, through a bore 259 provided in a washer 263. The nut 235 is screwed on the threaded portion of the stem 231 until the head 227 and the nut 235 (on the washer 263 and the nut 235) are respectively close and the intermediate portions 57 and the connecting members 19.

Advantageously, each connecting member 19, each intermediate portion 57 and each short rear leg 43 may be provided with recess 20, 58 and 44 for housing heads 225 and 227, eventually washers 247 and 263, and nuts 233 and 235.

Preferably, washers 169, 181, 193, 205, 217, 245 and 261 are made of plastic material.

Figure 2:
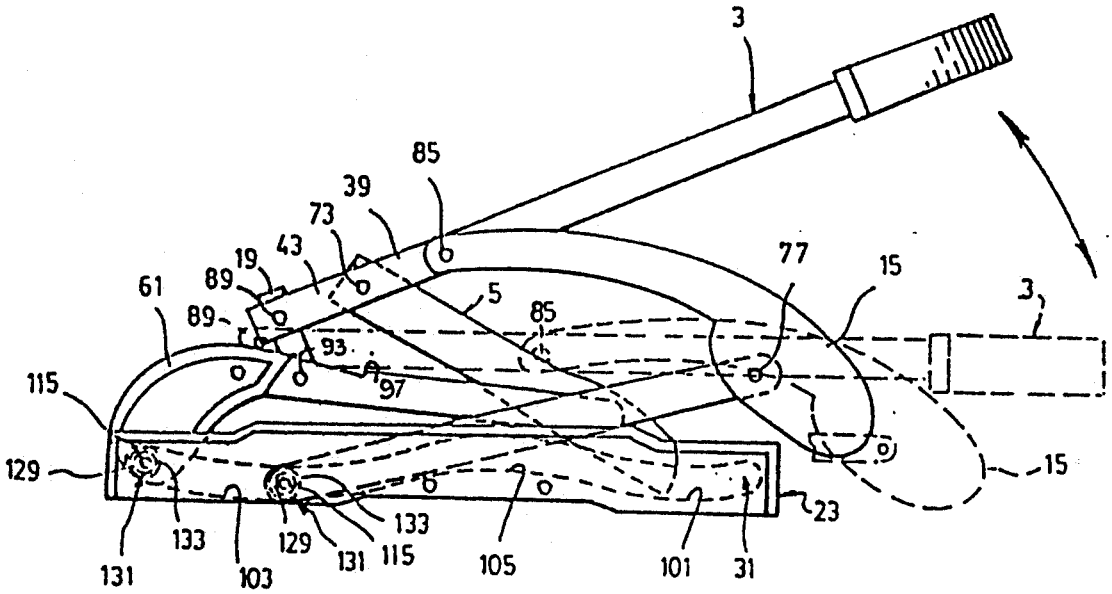
FIG. 2 is a side elevational view of the rocking chair of FIG. 1 represented in a partly folded position (in full lines) and represented in part in a completly folded position (dotted lines)

According to a particularly preferred embodiment of the invention, each riding surface 110 preferably comprises two portions bowed downwardly to define valleys 101,103, and one portion bowed upwardly to define a hill 105 and connecting the two other portions together (see FIGS. 1 and 2).

Advantageously, each riding surface 110 is defined by the bottom of an element 107 having a "U" shaped cross section and made of flexible material (e.g. P.V.C.). This element may be fastened by any appropriate means with the lower part 109 of a corresponding cavity 31. Each side branche of the "U" defines guiding means for rolling means 63.

Figure 3:
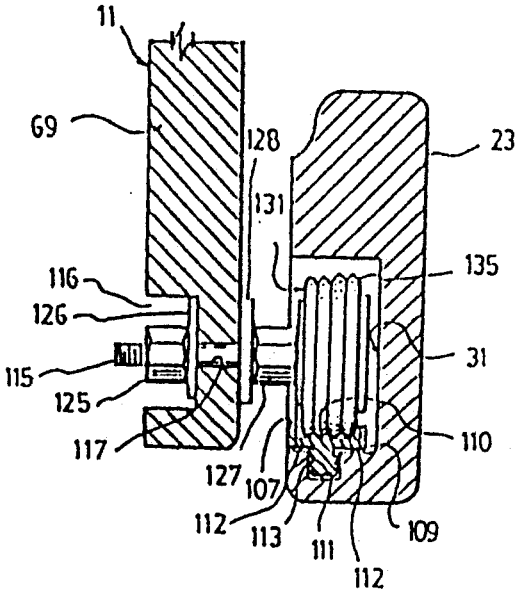
FIG. 3 is a cross sectional view according to III—III in FIG. 1 of the rail and the front leg showing the positioning of a roller on a corresponding riding surface.

Preferably, as illustrated in FIG. 3, the lower part 109 of the cavity 31 is provided with a groove 111, and the element 107 is provided with a tongue 113 (especially a tongue provided with barbs) that is inserted into the groove 111 to ensure an adequate fastening of the element 107 with the lower part 109 of the cavity 31. More particularly, a groove 111 extends along the whole lenght of the lower part of a cavity, and a tongue 113 extends along the whole lenght of an element 107.

Rolling means 63, which are identical, are similarily mounted near the end of each lower portion 61 of main rear legs 7 and near the end of each front legs 69. Referring to FIG. 3, rolling means 63 consists of a shaft 115 having one end threaded and locked in a bore 117 of a corresponding legs 69, between two washers 126,128 and two nuts 125,127 screwed in opposite direction. The opposite end of the shaft 115 is locked, by any appropriate means into the inner race 129 of a roller 131 of the type comprising an inner race 129 and an outer race 133 (especially a conventional roller bearing). The outer race 133 is intended to ride on a corresponding riding surface 110. Preferably, the outer race may be coated with a layer 135 of flexible material (e.g. P.V.C.). This may contribute to eliminate noise when a roller 131 rides on a riding surface 110. Rolling means 63 identical to the one mounted to the front leg 69, are mounted near the end of the lower portion 61 of each main rear leg 7. Advantageously, each main rear leg 7 and each front leg 69 may be provided with a recess 116 for housing the nut 125 and the washer 126. Advantageously, rubber cushions 112 may be positioned between the element 107 and the lower part 109 of the cavity. These cushions may consist of strips of rubber.

Stiles 39, arms 15, front members 11, main rear legs 7, seat 5 and connecting members 19, are movable around pivoting axis defined by their corresponding connectors 73,77, 81, 85, 89, 93 and 95 between a folded position (as partly represented in FIG. 2) and an unfolded position (as represented in FIG. 1).

The folded position is obtainable when the back 3 is tilted around pivoting axis defined by connectors 73 over the seat 5, connecting members 19 are moved around pivoting axis defined by connectors 89,93 from a locked position where pivoting axis defined by connectors 89 are positioned ahead a plane "A" substantially coplanar with pivoting axis defined by connectors 73,93 (see FIG. 4) and each short rear leg 43 applies against the intermediate portion 57 (and according to a particularly preferred embodiment against a stopper 97) of a corresponding main rear leg 7, to an unlocked position where pivoting axis defined by connectors 89 is positioned behind the plane "A", (and according to a particularly preferred embodiment, short rear legs 43 are away from stoppers 97), ends of arms 15 are moved around corresponding pivoting axis defined by connectors 81,85, front members 11 are moved around pivoting axis defined by connectors 77 in such a way that rolling means 63 defined hereinabove, of the front legs 69 are ridden on riding surfaces 110 from a first position where rolling means 63 of the front legs 69 are positioned ahead a substantially vertical plane "B" (see FIG. 1) coplanar with pivoting axis defined by connectors 77, to a second position where rolling means 63 of the front legs 69 are positioned behind the plane "B" and toward rolling means 63 of main rear legs 7, and back 3, arms 15, seat 5, intermediate and upper portion 57,53 of main rear legs 7 and front members 11 are lowered toward the base 1.

The unfolded position is obtainable when the back 3 is tilted around pivoting axis defined by connectors 73 away from the seat 5, connecting members 19 are moved around pivoting axis defined by connectors 89,93 from an unlocked position where pivoting axis defined by connectors 89 are positioned behind the plane "A" (see FIG. 4), to a locked position where pivoting axis defined by connectors 89 are positioned ahead the plane "A" and each short rear leg 43 applies against the intermediate portion 57 (and according to a particularly preferred embodiment, the stopper 97) of a corresponding main rear leg 7, ends of arms 15 are moved around corresponding pivoting axis defined by connectors 81,85, front members 11 are moved around pivoting axis defined by connectors 77 in such a way that rolling means 63 defined hereinabove, of the front legs 69 are ridden on riding surfaces 110 from the second position where rolling means 63 of the front legs 69 are positioned ahead the plane "B" and away from rolling means 63 of main rear legs 7, and back 3, arms 15, seat 5, intermediate and upper portion 57,53 of main rear legs 7 and front members 11 are raised over the base 1.

According to a particularly preferred embodiment of the invention, as illustrated in FIGS. 1, 2 and 4, when pivoting axis defined by connectors 89 are positioned ahead the plane "A" (i.e. in a locked position), the end of each short rear leg 43 simultaneously applies against the corresponding intermediate portion 57 and the corresponding stopper 97, to thus limit the movement of the back around the axis defined by connectors 73 when the back 3 is moved away from the seat 5.

Figure 11:
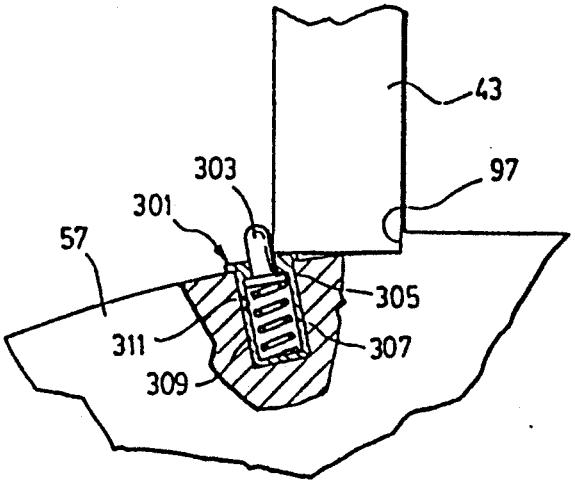
FIGS. 11 and 12 are cross-sectional views of an optional latch intended to lock a short rear leg against a corresponding intermediate portion and a corresponding stopper.
Figure 12:
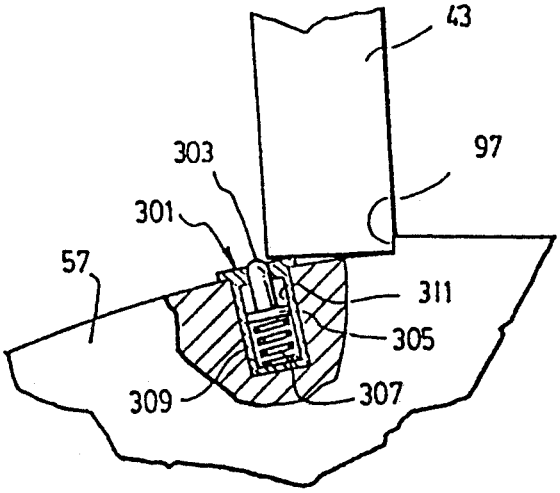

Furthermore, according to an advantageously preferred embodiment of the invention, a latch 301 may be provided in each intermediate portion 57 in order to lock short rear legs 43 against intermediate portions 57 and stoppers 97. Each latch 301 which is positioned in a bore 311 provided in a corresponding intermediate portion 57, may be of the type comprising a sleeve 309 housing a pin 303 having a base 305, said pin 303 being movable between two extreme positions. The first position is defined when the pin 303 is raised above the sleeve 309 (see FIG. 11) by the action of the spring 307 against a base 305, in order to engage a corresponding short rear leg 43 and keep it against the corresponding intermediate portion 57 and the corresponding stopper 97. The second position is defined when the pin 303 is pushed in the sleeve 309 to allow the corresponding short rear leg 43 to be moved away from the corresponding intermediate portion 57 and the corresponding stopper 97.

Therefore, in order to use the rocking chair "C" according to the invention, in its unfolded position as represented in FIG. 1, someone can sit thereon and rock himself in that chair by riding rollers 131 on riding surfaces 110, especially on the bottom of elements 107, so as rollers of the front legs ride successively along valley 101 and part of the hill 105, and rollers of the main rear legs 7 ride successively along valley 103 and the rear part of the hill 105.

When one wants to fold the chair "C", he just has to grasp the back 3 (eventually after having pushed pins 303 in sleeves 309) and bring it around pivoting axis defined by connectors 73 toward the seat 5 so as to move front members 11 around pivoting axis defined by connectors 77 in order to ride rollers 131 of the front legs 69 toward the rollers 131 of the lower portions 61 of the main rear legs 7 under the action of arms 15, that are moved around pivoting axis 81 and 85, and move the short rear legs 43 away from the intermediate portions 57 and stopper 97 by moving the connecting members 19 around pivoting axis defined by connectors 89 and 93 (as illustrated in dotted lines in FIG. 4), and this until the back 3 is positioned over the seat 5, and the back 3, the seat 5 the front members 11, the arms 15 and the main rear legs 7 be positionned close the base 1. In order to unfold the chair "C", the above steps only have to be reversed (eventually pins 303 have to be pushed in sleeves 309 to allow short rear legs 43 to apply against stoppers 97).

Each pin 303 may be pushed in the sleeve 309 by any appropriate means such as a finger of the user.

Advantageously, cross-ties may be provided between front legs 69 and main rear legs 7, as illustrated in FIG. 1.

Of course, the foldable rocking chair making the object of the present invention may be made of any appropriate material. According to a particularly preferred embodiment of the invention:

the stationary base 1, the back 3, the seat 5, main rear legs 7, front members 11 and connecting members 19 may be made of wood, metal or synthetic resins or polymers;

connectors 73, 77, 81, 85, 89 and 95 may be made of metal (especially of steel)

rollers 131, shafts 115, washers 126, 128 and nuts 125, 127 may be made of metal (especially of steel);

sleeves 309, pins 303, bases 305 may be made of wood, metal or synthetic resins or polymers (especially of metal or synthetic resins or polymers);

spring 307 may be made of spring steel.

Of course, the present invention also relates to any modification of the above embodiments that may be obvious for a man skilled in the art.

The embodiments of the invention in which an exclusive property or privilege is claimed are defined as follows:

1. A foldable rocking chair of the type comprising in combination:

a stationary base provided with parallel riding surfaces spaced apart from each other and connected together, each riding surface having a longitudinal axis and being undulated with respect to its longitudinal axis;

a back provided with a pair of stiles, each stile being spaced apart form each other, a lower portion of each stile defining a short rear leg;

a seat;

a pair of main rear legs, each leg having an upper portion, an intermediate portion and a lower portion, each lower portion being provided with a rolling means intended to ride forward and backward on a portion of a corresponding riding surface;

a pair of front members, each member having an upper portion defining a stem and a lower portion defining a front leg, each front leg being provided with a rolling means intended to ride forward and backward on a portion of a corresponding riding surface;

a pair of arms, each arm having opposite ends;

a pair of connecting members, each member having opposite ends;

six pairs of connectors, each connector defining means of the type for connecting parts together and for pivotally moving these parts around a pivoting axis that is substantially horizontal and perpendicular with respect to the longitudinal axis of riding surfaces, the pivoting axis of each connector of a same pair of connectors being substantially co-axial;

each connector of a first pair of connectors pivotally connecting the seat with a corresponding stile, just above the short rear leg, each connector of a second pair of connectors pivotally connecting the seat with the upper portion of a corresponding main rear leg and a corresponding front member between its upper and lower portions, one connector of a third and a fourth pairs of connectors, pivotally connecting, respectively, opposite ends of one arm with respectively a corresponding upper part of the front member and a corresponding stile, above the connector connecting the seat with that stile, the other connector of a third and fourth pairs of connectors, pivotally connecting, respectively, opposite ends of the other arm with respectively a corresponding upper part of the front member and a corresponding stile, above the connector connecting the seat with that stile, one connector of a fifth and sixth pairs of connectors, pivotally connecting, respectively, opposite ends of one connecting member with respectively an intermediate portion of a corresponding main rear leg and a corresponding short rear leg, the other connector of a fifth and sixth pairs of connectors, respectively, opposite ends of the other connecting member with respectively an intermediate portion of the main rear leg and the short rear leg, above mentioned stiles, arms, front members, main rear legs, seat and connecting members being movable around pivoting axis defined by their corresponding connectors between a folded position and an unfolded position, the folded position being obtainable when the back is tilted around pivoting axis of each connector of the first pair of connectors over the seat connecting members are moved around the pivoting axis defined by each connector of the fifth and sixth pairs of connectors from a locked position where pivoting axis defined by connector of the fifth pair of connectors are positioned ahead a plane that is substantially coplanar with the pivoting axis defined by connectors of the first and sixth pairs of connectors and each short rear leg applies against the intermediate portion of a corresponding main rear leg, to an unlocked position where pivoting axis defined by connector of the fifth pair of connectors, are positioned behind the plane that is substantially coplanar with the pivoting axis defined by connectors of the first and sixth pairs of connectors, ends of arms are moved around corresponding pivoting axis defined by connectors of the third and fourth pairs of connectors, front members are moved around the pivoting axis defined by each connector of the second pair of connectors in such a way that rolling means of the front legs are ridden on the riding surface from a first position where rolling means of the front legs are positioned ahead a substantially vertical plane coplanar with the pivoting axis defined by each connector of the second pair of connectors, to a second position where rolling means of the front legs are positioned behind the substantially vertical plane toward rolling means of the main rear legs, said arms, seat and upper portion of the main rear legs being lowered toward the base; and the unfolded position being obtainable when the aforesaid steps are reversed until pivoting axis defined by connector of the fifth pair of connectors, are positioned ahead the plane that is substantially coplanar with pivoting axis defined by connectors of the first and sixth pairs of connectors, short rear legs respectively apply against the intermediate portion of a corresponding main rear leg, and rolling means of the front legs are positioned ahead the vertical plane.

2. A foldable rocking chair according to claim 1, wherein the base is provided with a pair of parallel rails spaced apart from each other and connected together, each rail having a longitudinal axis and being provided with a cavity in a longitudinal side thereof, said cavity having a lower part, an upper part spaced apart from the lower part by a height, and a longitudinal axis parallel with the longitudinal axis of the rail; and wherein each ondulated riding surface is defined by the lower part of a corresponding cavity, being understood that the height of each cavity is sufficient to allow a free riding of rolling means on a corresponding riding surface.

3. A foldable rocking chair according to claim 2, wherein the intermediate portion of each main rear leg is further provided with a stopper, and wherein each short rear leg simultaneously applies against a corresponding intermediate portion and a corresponding stopper, when the corresponding connecting member has its pivoting axis defined by a connector of the fifth pair of connectors positioned ahead the plane coplanar with pivoting axis defined by each connector of the first and sixth pairs of connectors.

4. A foldable chair according to claim 3, wherein the cavity of each rail are facing to each other.

5. A foldable rocking chair according to claim 4, wherein each ondulated riding surface comprises two portions bowed downwardly to define valleys, and one portion bowed upwardly to define a hill and connecting the two other portions together.

6. A foldable rocking chair according to claim 4, wherein each riding surface is defined by the bottom of an element having a "U" shaped cross section and made of flexible material, said element being fastened with and following the lower part of a corresponding cavity comprising two portions bowed downwardly to define valleys and one portion bowed upwardly to define a hill and connecting the two other portions together.

7. A foldable rocking chair according to claim 6, wherein a latch is mounted on the intermediate portion of each main rear leg, said latch being movable between two extreme positions, the first position being defined when the latch may engage a corresponding short rear leg in order to lock it against the intermediate portion and the stopper of a corresponding main rear leg, the second position being defined when the latch is free of any engagement with the corresponding short rear leg.

8. A foldable rocking chair according to claim 3, wherein each rolling means mounted to a corresponding leg comprises a shaft having one end threaded and locked in a corresponding bore provided in said leg, between two nuts threaded thereon in opposite direction, the opposite end of this shaft being locked into the inner race of a roller bearing of the type comprising an inner race and an outer race, the outer race being intended to ride on one of the corresponding riding surfaces.

9. A foldable rocking chair according to claim 8, wherein the cavity of each rail are facing to each other.

10. A foldable rocking chair according to claim 9, wherein each ondulated riding surface comprises two portions bowed downwardly to define valleys and one portion bowed upwardly to define a hill and connecting the two other portions together.

11. A foldable rocking chair according to claim 9, wherein each riding surface is defined by the bottom of an element having a "U" shaped cross section and made of flexible material, said element being fastened with and following the lower part of a corresponding cavity comprising two portions bowed downwardly to define valleys and one portion bowed upwardly to define a hill and connecting the two other portions together.

12. A foldable rocking chair according to claim 11, wherein the outer race is coated with a layer of flexible material.

13. A foldable rocking chair according to claim 12, wherein a latch is mounted on the intermediate portion of each main rear leg, said latch being movable between two extreme positions, the first position being defined when the latch may engage a corresponding short rear leg in order to lock it against the intermediate portion and the stopper of a corresponding main rear leg, the second position being defined when the latch is free of any engagement with the corresponding short rear leg.

14. A foldable rocking chair according to claim 1, wherein:

the seat consists of two parallel boards spaced apart from each other and connected together with at least one top element;

each connector of the first, second, third and fourth pairs of connectors consists of a screw having a head and a stem whose a portion, opposite the head, is threaded, each connector of the first pair of connectors passing through a bore provided in a corresponding board of the seat and having its threaded portion screwed in a corresponding stile until the head is close the board, each connector of the second pair of connectors passing through a bore provided in a corresponding board of the seat and a bore provided in the upper portion of a corresponding main rear leg, and having its threaded portion screwed in the front member, between its upper and lower portion, until the head is close the board, each connector of the third pair of connectors passing through a bore provided in a corresponding arm, and having its threaded portion screwed in the upper portion of the front member until the head is close the arm, each connector of the fourth pair of connectors passing through a bore provided in a corresponding stile, and having its threaded portion screwed in a corresponding arm until the head is close the stile;

each connector of the fifth and sixth pairs of connectors consists of a bolt having a head and a stem whose a portion is threaded and a nut threadable on the bolt, each connector of the fifth pair of connectors passing through a bore provided in a corresponding connecting member and a bore provided in a corresponding short rear leg, the nut being screwed on the bolt until the head and the nut are close the connecting member and the short rear leg, each connector of the sixth pair of connectors passing through a bore provided in a corresponding member and a bore provided in the intermediate portion of a corresponding main rear leg, the nut being screwed on the bolt until the head and the nut are close the connecting member and the intermediate portion.

15. A foldable rocking chair according to claim 14, wherein each rolling means mounted to a corresponding leg comprises a shaft having one end threaded and locked in a corresponding bore provided in said leg, between two nuts threaded thereon in opposite direction, the opposite end of this shaft being locked into the inner race of a roller bearing of the type comprising an inner race and an outer race, the outer race being intended to ride on one of the corresponding riding surfaces.

16. A foldable rocking chair according to claim 15, wherein the outer race is coated with a layer of flexible material.

17. A foldable rocking chair according to claim 1, wherein:

the seat consists of two parallel boards spaced apart from each other and connected together with at least one top element;

each connector of the first, second, third and fourth pairs of connectors consists of a screw having a head and a stem whose a portion, opposite the head, is threaded, each connector of the first pair of connectors passing successively through a bore provided in a corresponding board of the seat and through a bore provided in a washer, and having its threaded portion screwed in a corresponding stile until the head is close the board, each connector of the second pair of connectors passing successively through a bore provided in a corresponding board of the seat, through a bore provided in a washer, through a bore provided in the upper portion of a corresponding main rear leg and through a bore provided in another washer, and having its threaded portion screwed in the front member, between its upper and lower portions, until the head is close the board, each connector of the third pair of connectors passing sucessively through a bore provided in a corresponding arm and through a bore provided in a washer, and having its threaded portion screwed in the upper portion of the front member until the head is close the arm, each connector of the fourth pair of connectors passing respectively through a bore provided in a corresponding stile and through a bore provided in a washer, and having its threaded portion screwed in a corresponding arm until the head is close the stile, each connector of the fifth and sixth pairs of connectors consists of a bolt having a head and a stem whose a portion opposite the head is threaded and a nut threadable on the bolt, each connector of the fifth pair of connectors passing respectively through a bore provided in a corresponding connecting member, a bore provided in a washer and a bore provided in a corresponding short rear leg, the nut being screwed on the bolt until the head and the nut are close the connecting member and the short rear leg, each connector of the sixth pair of connectors passing respectively through a bore provided in a corresponding connecting member, a bore provided in a washer and a bore provided in the intermediate portion of a corresponding main rear leg, the nut being screwed on the bolt until the head and the nut are close the connecting member and the intermediate portion.

18. A foldable rocking chair according to claim 17, wherein each rolling means mounted to a corresponding leg comprises a shaft having one end threaded and locked in a corresponding bore provided in said leg, between two nuts threaded thereon in opposite direction, the opposite end of this shaft being locked into the inner race of a roller bearing of the type comprising an inner race and an outer race, the outer race being intended to ride on one of the corresponding riding surfaces.

19. A foldable rocking chair according to claim 18, wherein the outer race is coated with a layer of flexible material.

20. A foldable rocking chair according to claim 17, wherein each washer is made of plastic material.

* * * * *